US011285528B2

(12) United States Patent
Lu et al.

(10) Patent No.: US 11,285,528 B2
(45) Date of Patent: Mar. 29, 2022

(54) CHEMICAL REGENERATION METHOD OF WATER GLASS USED SAND

(71) Applicant: WUHAN TEXTILE UNIVERSITY, Wuhan (CN)

(72) Inventors: Jijun Lu, Wuhan (CN); Kaisheng Yang, Wuhan (CN); Zili Xu, Wuhan (CN); Lianqing Yu, Wuhan (CN); Xin Lu, Wuhan (CN); Jichang Li, Wuhan (CN)

(73) Assignee: WUHAN TEXTILE UNIVERSITY, Wuhan (CN)

( * ) Notice: Subject to any disclaimer, the term of this patent is extended or adjusted under 35 U.S.C. 154(b) by 0 days.

(21) Appl. No.: 17/412,282

(22) Filed: Aug. 26, 2021

(65) Prior Publication Data

US 2021/0387247 A1 Dec. 16, 2021

Related U.S. Application Data

(63) Continuation of application No. PCT/CN2020/113864, filed on Sep. 8, 2020.

(30) Foreign Application Priority Data

Sep. 9, 2019 (CN) ..... 201910849455.3

(51) Int. Cl.
*B22C 5/04* (2006.01)
*B22C 1/02* (2006.01)
*B22C 5/06* (2006.01)

(52) U.S. Cl.
CPC ..... *B22C 5/0409* (2013.01); *B22C 1/02* (2013.01); *B22C 5/06* (2013.01)

(58) Field of Classification Search
CPC .... B22C 1/02; B22C 1/10; B22C 1/16; B22C 1/167; B22C 1/18; B22C 5/04; B22C 5/0409; B22C 5/06
USPC ..... 164/5, 520, 529
See application file for complete search history.

(56) References Cited

FOREIGN PATENT DOCUMENTS

| | | | |
|---|---|---|---|
| CN | 1481950 | A | 3/2004 |
| CN | 10869965 | A | 10/2010 |
| CN | 109967693 | A | 7/2019 |
| CN | 110125329 | A | 8/2019 |
| CN | 210915588 | U | 7/2020 |
| CN | 211625931 | U | 10/2020 |
| CN | 211686181 | U | 10/2020 |
| GB | 191120204 | A | 9/1912 |
| JP | S52133024 | A | 11/1977 |

*Primary Examiner* — Kevin P Kerns

(57) ABSTRACT

A chemical regeneration method of water glass used sand, which belongs to the field of resource recycling in the casting industry. The present invention adopts a two-component reagent composed of calcium oxide and tap water, an emulsion composed of sucrose and calcium oxide, and a calcium chloride aqueous solution to process the regeneration of the used sand, and prepares the sample of the reclaimed sand obtained after the reagent mixed with the used sand is sealed and placed for 0 to 24 hours respectively, and tests the properties of the sample including: initial strength, final strength and collapsibility, and sodium carbonate content, and compares the properties of raw sand and used sand after the tests. Among several regeneration methods, each property index of the reclaimed sand obtained by using calcium oxide and tap water to regenerate for 12 hours is the best.

10 Claims, 1 Drawing Sheet

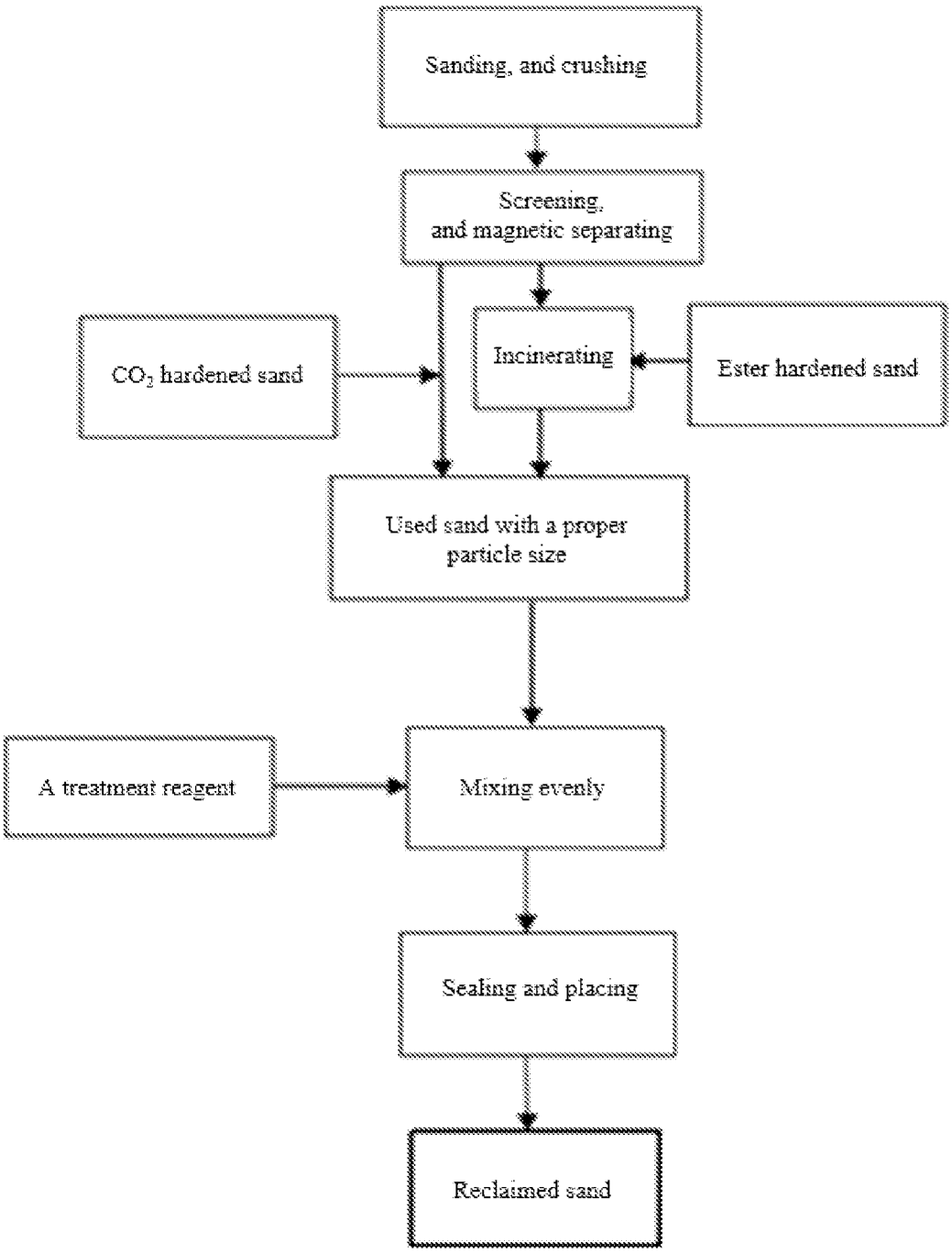
Sanding, and crushing
Screening, and magnetic separating
$CO_2$ hardened sand
Incinerating
Ester hardened sand
Used sand with a proper particle size
A treatment reagent
Mixing evenly
Sealing and placing
Reclaimed sand

CHEMICAL REGENERATION METHOD OF WATER GLASS USED SAND

CROSS-REFERENCE TO RELATED APPLICATIONS

The application claims priority to Chinese patent application No. 201910849455.3, filed on Sep. 9, 2019, the entire contents of which are incorporated herein by reference.

TECHNICAL FIELD

The present disclosure relates to the field of resource recycling in the casting industry, and particularly relates to a chemical regeneration method of water glass used sand.

BACKGROUND

As a large casting country, China needs to change to a strong casting country in the new era, which needs to pay more attention to environmental protection and energy conservation. Water glass used sand is divided into two types: ester hardened used sand and $CO_2$ hardened used sand, in view of the widespread use of water glass sand in the casting industry, in order to avoid environmental damage and waste of resources caused by random abandonment, regenerating the used sand is necessary. In today's technology, there are multiple regeneration options including physical and chemical forms; for example, dry process regeneration, wet process regeneration, composite regeneration and chemical regeneration, etc., these technologies have their own advantages and disadvantages. Dry and wet process regenerations have been extensively studied at present. Dry process regeneration is simple and easy to realize, but it has low recycling and film removal rate; wet process regeneration works well, but it costs a lot of water, which remains tons of sewage to be treated difficultly. However, there are few researches on chemical regeneration technology world wide. Although the main achievement is that the strength of reclaimed sand is improved greatly by using sodium hydroxide for regeneration treatment, the continuous accumulation of reclaimed sand alkali will affect the use properties of reclaimed sand, and the waste sand will directly pollute the environment. There is still a lot of development space for chemical regeneration, and in the current research background, we hope to find a more suitable solution which can effectively reduce the content of sodium carbonate when the reclaimed sand meets the strength requirements.

This application is filed on the above grounds.

SUMMARY

For problems or defects existing in the prior art, the object of the present disclosure is to provide a chemical regeneration method of water glass used sand. In the present disclosure, under the condition of choosing a chemical reagent which has no pollution to the environment, the water glass used sand is recycled into a reclaimed sand which meets the use requirements. The present disclosure aims for the popularization and application of the water glass sand and reducing the enterprise cost.

In order to achieve the above object of the present disclosure, the technical solution adopted by the present disclosure is as follows:

a chemical regeneration method of water glass used sand, comprising the following steps:

crushing, screening and magnetically separating collected the water glass used sand to obtain water glass used sand at a desired particle size; and

S2: mixing a treatment reagent with the obtained water glass used sand in step S1 at room temperature and then stirring for 2 to 10 minutes; after stirring, sealing and placing a mixed sand sample for no more than 24 hours to obtain reclaimed sand; wherein: the treatment reagent is one of the following reagents:

a) an emulsion composed of sucrose and calcium oxide;

b) a two-component reagent composed of calcium oxide and tap water;

c) an aqueous calcium chloride solution;

d) an aqueous magnesium chloride solution or aqueous magnesium sulfate solution.

Specifically, in the above technical solution, the water glass used sand in step S1 is any of ester hardened used sand or $CO_2$ hardened used sand.

Further, when the water glass used sand is the ester hardened used sand, the steps performed before step S2, also include: incinerating the ester hardened used sand, and an incineration atmosphere is air, an incineration temperature is from 350° C. to 800° C., preferably from 400° C. to 600° C., and 500° C. is better; and an incineration time is from 10 to 30 minutes.

Further, in the above technical solution, the normal temperature in step S2 refers to the natural room temperature conditions in the four seasons, without additional cooling or heating treatment, and the normal temperature is generally controlled from 10° C. to 30° C., preferably from 15° C. to 25° C.

Further, the two-component reagent composed of the calcium oxide and the tap water is preferably chosen as the treatment reagent of step S2.

Preferably, a mass ratio of the tap water to the water glass used sand is (from 1 to 10): 100, and more preferably the mass ratio of the tap water to the water glass used sand is (from 2 to 4): 100.

Preferably, the mass ratio of the calcium oxide to the water glass used sand is (from 0.5 to 5): 100, and more preferably the mass ratio of the calcium oxide to the tap water glass used sand is (from 0.5 to 1): 100.

Further, in the above technical solution, a concentration of calcium chloride aqueous solution, magnesium chloride aqueous solution or magnesium sulfate aqueous solution is 40 wt % to 60 wt %, and preferably 50 wt %.

Further, in the above technical solution, preferably sealing and placing the mixed sand sample for 12 hours.

Further, in the above technical solution, the packing of sealing the mixed sand sample described in step S2 is not limited, as long as the function of blocking air can be realized, and a plastic film bag is preferably chosen to seal the mixed sand sample.

Compared with the prior art, the present disclosure relates to the chemical regeneration method of water glass used sand, comprising the following beneficial effects:

The present disclosure chooses two-component reagent composed of calcium oxide and tap water, emulsion composed of sucrose and calcium oxide, calcium chloride aqueous solution, magnesium chloride aqueous solution and magnesium sulfate aqueous solution through an exploratory test to process the regeneration of the water glass used sand, and prepares the sample of the reclaimed sand obtained after the reagent mixed with the water glass used sand is sealed and placed in the 0 hour, 2 hours, 4 hours, 6 hours, 8 hours, 12 hours, 18 hours, 20 hours, and 24 hours respectively, and prepares the sample and tests the properties of the sample including: initial strength, final strength and collapsibility, as well as sodium carbonate content of reclaimed sand, and compares the properties of raw sand and water glass used sand after the tests. Among several regeneration methods of the present disclosure, each property index of the reclaimed sand obtained by using calcium oxide and tap water to regenerate for 12 hours is the best, and compared with the raw sand, the initial strength increases by 60%, the final strength increases by 154%, the collapsibility of the reclaimed sand is slightly worse than the collapsibility of the raw sand, and better than the collapsibility of the water glass used sand; the sodium carbonate content reduces by 1.38% compared with the used sand, which meets the use requirements.

BRIEF DESCRIPTION OF DRAWINGS

FIG. 1 illustrates a process flow diagram of a chemical regeneration method of water glass used sand of the present disclosure.

DETAILED DESCRIPTION OF THE EMBODIMENTS

The present disclosure is further explained by the embodiments. The embodiments of present disclosure is implemented under the premise of the technology of the present disclosure, detailed implementation method and specific operation process are presented to show the present disclosure has creativity, but the scope of protection is not limited to the following embodiments.

According to the information contained in the present application, it is easy for those skilled in the art to make various changes to the precise description of the present disclosure without departing from the spirit and scope of the appended claims. It should be understood that the scope of the present disclosure is not limited to a defined process, property or component, as these embodiments and other descriptions are intended solely to illustrate specific aspects of the present disclosure. In fact, it is apparent to those skilled in the art or related art that various changes that can be made to the embodiments of the present disclosure are covered by the appended claims.

In order to better understand the disclosure and not to limit the scope of the present disclosure, all numbers representing amounts, percentages, and other values used in the present application should in all cases be understood to be modified by the word "approximately". Therefore, unless otherwise specified, the numerical parameters listed in the description and the appended claims are approximate values, which may vary depending on the desired nature sought to be obtained. At a minimum, each numerical parameter should be considered based on the significant figures reported and by the usual rounding method.

In the following embodiments from 1 to 14 of the present disclosure, the raw sand for producing steel castings made in Fujian, the grain size of which is 50/100, and the used sand is obtained by crushing and screening the waste used sand produced by a certain enterprise in Jiangsu after producing a steel casting piece (the same raw sand is used), and the grain size distribution of the raw sand and the used sand is shown in Table 1.

TABLE 1

Particle Size Distribution of Raw Sand and Used Sand (%)

| Mesh number (No.) | 30 | 40 | 50 | 70 | 100 | 140 | 200 | >200 | Total |
|---|---|---|---|---|---|---|---|---|---|
| Raw sand | 6.04 | 5.74 | 28.49 | 36.76 | 22.86 | 5.04 | 0.40 | 0.10 | 99.30 |
| Used sand after screening | 4.3 | 11.48 | 26.06 | 31.04 | 17.37 | 4.55 | 1.39 | 3.76 | 99.95 |

The water glass is produced in Wuhan, with modulus of 3.1 and density of 1.32. When using the water glass, a certain amount of NaOH saturated solution is added and mixed evenly to adjust the modulus and density of water glass, and after the adjustment, the modulus of the water glass is 2.3 and the density is 1.37. The added amount of the water glass accounts for 6.0% of the raw sand; and the sand sample for properties test is prepared by hollow cylindrical sample bucket on hammer-type sample preparation machine, with a diameter of 30 mm and a height of 30 mm.

Carbon dioxide gas is used for water glass hardening: a bottle of industrial $CO_2$ gas manufactured by a company in Wuhan is used, with blowing flow rate of 15 L/min and blowing time of 20 seconds.

Embodiment 1 a chemical regeneration method of water glass used sand of this embodiment, the regeneration process is as follows: putting 500 g of used sand into the stirring pot, adding 10 g of calcium oxide powder (2% by mass of sand), turning on the mixer, adding 20 g of tap water (4% by mass of sand) while stirring, and stirring for three minutes to obtain reclaimed sand.

Study on properties of the reclaimed sand: preparing samples of the reclaimed sand obtained separately, and testing the properties of the sample, including initial strength, final strength, usable time and collapsibility, and measuring sodium carbonate content of the reclaimed sand.

Sample preparation steps are as follows: taking 500 g of reclaimed sand, using a micro pipette to take 30 g of water glass, pouring it into a stirring pot and stirring the reclaimed sand sample for three minutes, and taking down the stirring pot after stirring; and carrying out the sample preparation with a hammer type sample preparation machine, using an electronic balance to weigh 33 g of mixed sand each time, and using 15 ml/min of $CO_2$ to blow for 20 seconds to harden the sample; taking out the sample after blowing, when three consecutive samples are prepared, measuring their initial strength with hydraulic universal strength tester, which is 0.241 MPa, 0.402 MPa, 0.340 MPa respectively. Then, continuing to use the above steps for sample preparation and placing the sample in a tray for 24 hours; after 24 hours, measuring the final strength with hydraulic universal strength testing machine, and seeing Table 2 for each data.

Determination of collapsibility of reclaimed sand: selecting five samples for the determination of collapsibility, turning on the high-temperature box-type resistance furnace in advance and preheating for about two hours to make the furnace temperature reach 800° C.; when the temperature reaches the requirements, placing the sample with iron plate and putting the iron pliers into the high-temperature box-type resistance furnace, closing the furnace door and keeping the furnace heated at 800° C. for 20 minutes. When the time is up, taking out the sample for natural cooling, and using the hydraulic universal strength testing machine to measure the retained strength when the sample is prepared at normal temperature, and the greater the retained strength, the worse the collapsibility; and testing the retained strengths of the five samples respectively, and listing the initial strength, final strength and data of reclaimed sand in Table 2 below.

TABLE 2

Effect of Regeneration of Calcium Oxide and Tap Water for 20 Hours on Strength of Used Sand

| Embodiments | Initial strength MPa | Final strength MPa | retained strength MPa |
|---|---|---|---|
| Reclaimed sand (20 h) | 0.241 | 3.670984 | 2.900 |
| | 0.402 | 3.344838 | 2.921 |
| | 0.340 | 3.088102 | 2.033 |

Determination of sodium carbonate content: using a volumetric carbonate content test device to test the determination of sodium carbonate content, putting 50 g of reclaimed sand or used sand into a beaker, and adding tap water to submerge, and putting into an ultrasonic cell mill, and then processing for 15 minutes. After the process, using circulating water type multi-purpose vacuum pump (SHB-111) to extract and filter, pouring the filtrate into the volumetric flask of carbonate content testing device, and adding tap water to constant volume to 250 ml; taking 10 ml (about 10 g) of the constant volume solution, and putting the constant volume solution into a round bottom flask, dropping in the methyl red indicator (yellow), and the putting the solution on the constant temperature magnetic heating stirrer (putting the magnet into the flask), and turning on the power supply after the installation is correct; taking note of the initial scale, titrating with hydrochloric acid at a concentration of 0.64 mol/L, and adjusting the switch of the U-tube next to it while dripping hydrochloric acid. When the solution in the round bottom flask turns red, stop dripping hydrochloric acid, and writing down the termination scale when the liquid levels on both sides of the U-shaped tube are level. The above process was carried out three times continuously, and the data are shown in Table 3 below.

TABLE 3

Sodium Carbonate Content Determination of $CO_2$ Volume

| | Initial scale | End scale | $CO_2$ volume(ml) |
|---|---|---|---|
| First group | 5.5 | 16.1 | 10.5 |
| Second group | 17.1 | 26.3 | 9.8 |
| Third group | 26.3 | 37.1 | 10.8 |

The average $CO_2$ volume is (10.5+9.8+10.8)/3=10.4 ml, and calculating the sodium carbonate content according to the following formula:

$$\text{sodium carbonate content}(\%) = \frac{V \times Mr1}{22.4 \times m \times 1000} \times 100\%;$$

wherein:

V—volume of carbon dioxide production (U-tube liquid level drop volume) ml;

Mr1—molecular weight of sodium carbonate is 106;

22.4 represents the volume (1) of 1 mol of gaseous substance in the standard case;

m—Mass of sample taken (g).

$$\text{Sodium carbonate content}(\%) = \frac{10.4 \times 106}{22.4 \times 10 \times 1000} \times 100\% = 0.49\%.$$

Embodiment 2 the chemical regeneration method of water glass used sand of this embodiment described is basically the same as the Embodiment 1, and the difference is only: adding 1.0 g of calcium oxide powder, after stirring, sealing and placing the mixed sand sample for 2 hours to obtain reclaimed sand.

Embodiment 3 the chemical regeneration method of water glass used sand of this embodiment described is basically the same as that of Embodiment 1, and the difference is only:

adding 1.0 g of calcium oxide powder, after stirring, sealing and placing the mixed sand sample for 4 hours to obtain reclaimed sand.

Embodiment 4 the chemical regeneration method of water glass used sand of this embodiment described is basically the same as that of Embodiment 1, and the difference is only:

adding 1.0 g of calcium oxide powder, after stirring, sealing and placing the mixed sand sample for 6 hours to obtain reclaimed sand.

Embodiment 5 the chemical regeneration method of water glass used sand of this embodiment described is basically the same as that of Embodiment 1, and the difference is only:

adding 1.0 g of calcium oxide powder, after stirring, sealing and placing the mixed sand sample for 8 hours to obtain reclaimed sand.

Embodiment 6 the chemical regeneration method of water glass used sand of this embodiment described is basically the same as that of Embodiment 1, and the difference is only:

adding 1.0 g of calcium oxide powder, after stirring, sealing and placing the mixed sand sample for 12 hours to obtain reclaimed sand.

Embodiment 7 the chemical regeneration method of water glass used sand of this embodiment described is basically the same as that of Embodiment 1, and the difference is only:

adding 1.0 g of calcium oxide powder, after stirring, sealing and placing the mixed sand sample for 18 hours to obtain reclaimed sand.

Embodiment 8 the chemical regeneration method of water glass used sand of this embodiment described is basically the same as that of Embodiment 1, and the difference is only:

adding 1.0 g of calcium oxide powder, after stirring, sealing and placing the mixed sand sample for 24 hours to obtain reclaimed sand.

Mixing the reclaimed sand obtained in Embodiments 2 to 8 with 6% water glass, and preparing the sample, and testing the properties of the reclaimed sand. The test results are shown in Table 4.

TABLE 4

Properties Comparison of Reclaimed Sand Regenerated at Different Regenerative Time in Embodiments 2 to 8

| Embodiments | Initial strength MPa | Final strength Mpa | Residual strength Mpa |
|---|---|---|---|
| Embodiment 2 | 0.296 | 0.595 | 3.077 |
| Embodiment 3 | 0.332 | 0.613 | 3.158 |
| Embodiment 4 | 0.330 | 0.627 | 2.661 |
| Embodiment 5 | 0.328 | 0.643 | 2.599 |
| Embodiment 6 | 0.374 | 0.690 | 2.487 |
| Embodiment 7 | 0.474 | 0.679 | 2.700 |
| Embodiment 8 | 0.396 | 0.727 | 2.620 |

It can be seen from Table 4 that the regeneration time has a great influence on the properties of reclaimed sand. With the prolonging of regeneration time, the regeneration effect becomes better, and the properties of reclaimed sand are improved (the strength is improved and the collapsibility is improved).

Embodiment 9 the chemical regeneration method of water glass used sand of this embodiment described is basically the same as the Embodiment 8, and the difference is only:

the amount of tap water in this embodiment is 20 g (4%).

Embodiment 10 the chemical regeneration method of water glass used sand of this embodiment described is basically the same as the Embodiment 8, and the difference is only:

the amount of tap water in this embodiment is 30 g (4%).

Mixing the reclaimed sand obtained in Embodiments 8 to 10 with 6% water glass, and preparing the sample, and testing the properties of the reclaimed sand. The test results are shown in Table 5.

TABLE 5

Properties Comparison of Reclaimed Sand with Different Water Content

| Embodiments | Initial strength MPa | Final strength MPa | retained strength MPa |
|---|---|---|---|
| Embodiments 8 | 0.396 | 0.727 | 2.620 |
| Embodiments 9 | 0.723 | 1.758 | 2.921 |
| Embodiments 10 | 0.613 | 4.629 | 4.425 |

It can be seen from Table 5 that the reclaimed water addition has a great impact on the properties of reclaimed sand. Within a certain range, with the increase of the recycled water consumption, the reclaimed sand property strength is significantly improved, but the collapsibility is significantly reduced, which means that the reclaimed sand can be added with less water glass and the amount of water glass binder can be saved.

Embodiment 11 adding the raw sand with the same water glass as the reclaimed sand in Embodiment 1 to obtain a mixed sand sample, and preparing the sample, measuring the initial strength of the sample preparation, the final strength and the retained strength after placing the sample for 24 hours respectively, and the specific operation is as follows:

using an electronic balance to weigh 500 g of purchased raw sand, and putting the 500 g of purchased raw sand into a stirring pot, using a micro pipette to take 30 g of water glass, pouring it into the stirring pot, and placing the mixing pot on the cement mortar mixer correctly, turning on the switch to select the low speed gear, and stirring for three minutes; removing the stirring pot after stirring. And carrying out the sample preparation with a hammer type sample preparation machine, preparing a batch of samples every 10 minutes, using an electronic balance to weigh 33 g of mixed sand each time, and using 15 ml/min of $CO_2$ to blow for 20 seconds to harden the sample; taking out the sample after blowing, and after three consecutive samples are prepared, measuring their initial strength with hydraulic universal strength tester. Then, continuing to use the above steps for sample preparation and placing the sample preparation in a tray for 24 hours; after 24 hours, measuring the final strength with hydraulic universal strength testing machine, and seeing Table 2 for each data.

Selecting five samples for the determination of collapsibility: turning on the high-temperature box-type resistance furnace in advance and preheating for about two hours to make the furnace temperature reach 800° C.; when the temperature reaches the requirements, placing the sample with iron plate and putting the iron pliers into the high-temperature box-type resistance furnace, closing the furnace door and keeping the furnace heated at 800° C. for 20 minutes. After reaching the time, taking out the sample for natural cooling, and using the hydraulic universal strength testing machine to measure the retained strength when the sample is prepared at normal temperature; and testing the retained strengths of the five samples respectively to obtain the collapsibility, and listing the initial strength, final strength and retained strength data of raw sand in Table 6 below.

TABLE 6

Strength Test Results of raw sand in Example 11

| Sand sample type | initial strength (MPa) | Sample preparation time Min | Final strength (MPa) | retained strength (MPa) |
|---|---|---|---|---|
| raw sand | 0.164 | 10 | 1.246 | 1.175 |
| | 0.164 | 20 | 1.317 | 1.707 |
| | 0.166 | 30 | 1.194 | 1.105 |

Embodiment 12 adding the used sand with the water glass to obtain a mixed sand sample, and preparing the sample, measuring the initial strength of the sample preparation, the final strength and the retained strength after placing the sample for 24 hours respectively, and the specific operation is as follows:

using an electronic balance to weigh 500 g of purchased raw sand, and putting the 500 g of purchased raw sand into a stirring pot, using a micro pipette to take 30 g of water glass, pouring it into the stirring pot, and placing the mixing pot on the cement mortar mixer correctly, turning on the switch to select the low-speed gear, and stirring for three minutes; removing the stirring pot after stirring. And carrying out the sample preparation with a hammer type sample preparation machine, using an electronic balance to weigh 33 g of mixed sand each time, preparing a batch of samples every 10 minutes, and using 15 ml/min of CO2 to blow for 20 seconds to harden the sample; and taking out the sample after blowing, and after three consecutive samples are prepared, measuring their initial strength with a hydraulic universal strength tester. Then, continuing to use the above steps for sample preparation and the preparation time is from 10:12 to 10:39, placing the sample preparation in a tray for 24 hours; after 24 hours, measuring the final strength with hydraulic universal strength testing machine, and seeing Table 7 for each data.

Selecting five samples for the determination of collapsibility: turning on the high-temperature box-type resistance furnace in advance and preheating for about two hours to make the furnace temperature reach 800° C.; when the temperature reaches the requirements, placing the sample with iron plate and putting the iron pliers into the high-temperature box-type resistance furnace, closing the furnace door and keeping the furnace heated at 800° C. for 20 minutes. After reaching the time, taking out the sample for natural cooling, and using the hydraulic universal strength testing machine to measure the retained strength when the sample is prepared at normal temperature; according to the relationship that the greater the retained strength is, the worse the collapsibility of reclaimed sand is, the collapsibility of the reclaimed sand can be obtained, and listing the initial strength, final strength and retained strength data of the reclaimed sand in Table 7 below.

TABLE 7

Strength Test Results of Used Sand in Embodiment 12

| Sand sample type | initial strength (MPa) | Sample preparation time Min | Final strength (MPa) | retained strength (MPa) |
|---|---|---|---|---|
| Used sand | 0.340 | 5 | 0.737 | 1.833 |
| | 0.388 | 10 | 0.611 | 2.039 |
| | 0.412 | 20 | 0.414 | 1.717 |

It can be seen that the strength and serviceability of used sand without regeneration do not meet the process requirements.

In addition, the sodium carbonate content in the used sand of the embodiment is tested according to the same test method in Embodiment 1, and the sodium carbonate content in the used sand is measured to be 1.83%.

Embodiment 13 adding a solution (sucrose+calcium oxide) in the used sand, and mixing and stirring, after stirring, placing the mixture for 0 hour and 24 hours respectively, then adding water glass into the mixed sand sample and stirring again, and preparing the sample, measuring the initial strength, final strength and retained strength after 24 hours, and measuring the sodium carbonate of the mixed sand sample.

(1) Reaction Time is 0 Hour, which Means the Reclaimed Sand is not Sealed and Placed:

weighing rapidly and accurately 15 g of the sample refined into CaO powder, putting it into a 250 ml conical flask with a glass stopper, adding 100 g of chemical pure sucrose and 12-20 small glass balls, adding 100 ml of newly boiled and cooled tap water, plugging the flask tightly, shaking for 15 min, so as to reserve.

Regeneration process: putting 500 g of used sand into a stirring pot, using a micro pipette to take 20 g of the supernatant of the above prepared sucrose and calcium oxide solution, pouring it into the stirring pot, and stirring for three minutes; taking 30 g of water glass and continuing stirring for three minutes, after stirring again, carrying out the sample preparation, using an electronic balance to weigh 33 g of mixed sand each time to prepare the sample, and using 15 ml/min of $CO_2$ to blow for 20 seconds to harden the sample; and taking out the sample after blowing.

The properties test method of the reclaimed sand obtained after regeneration for 0 hour in this embodiment is the same as in Embodiment 1, and the test results are shown in Table 8.

TABLE 8

Effect of 0 hour regeneration of (sucrose + calcium oxide) mixture on Strength of Used Sand in Embodiment 13

| Sand sample type | initial strength (MPa) | Sample preparation time Min | Final strength (MPa) | retained strength (MPa) |
|---|---|---|---|---|
| reclaimed sand | 0.206 | 10 | 0.737 | 3.016 |
| (0 h) | 0.214 | 20 | 0.080 | 2.650 |
| | 0.199 | 30 | 0.051 | 1.393 |

It can be seen that after the used sand is mixed with the regenerant, the strength of the reclaimed sand does not meet the process requirements without placing.

In addition, according to the same test method of Embodiment 1, the sodium carbonate content in the reclaimed sand obtained by 0 hour regeneration of embodiment is tested, and the sodium carbonate content in the reclaimed sand is 0.60%, and the sodium carbonate removal rate is 67%.

(2) Reaction Time is 24 Hours:

Regeneration process: putting 500 g of used sand into a stirring pot, using a micro pipette to take 20 g of the supernatant of the prepared (sucrose and calcium oxide) solution, pouring it into the stirring pot, and stirring for three minutes; using a plastic film bag to seal the mixed sand sample, and placing it for 24 hours.

The properties test method of the reclaimed sand obtained after 24 hours of regeneration in the embodiment is the same as that in Embodiment 8, and the test results are shown in Table 9.

It can be seen that after the used sand is mixed with the regenerant, the strength of the reclaimed sand meets the process requirements completely.

Determination of sodium carbonate content: using the same test method as in Embodiment 1 to measure the sodium carbonate content of the reclaimed sand, the sodium carbonate content in the reclaimed sand obtained after regeneration for 24 hours in this embodiment is 0.38%, and the removal rate of sodium carbonate reaches 80%.

TABLE 9

| Effect of (sucrose + calcium oxide) Mixture Regeneration for 24 hours in Embodiment 13 on Strength of Used Sand | | | | |
|---|---|---|---|---|
| Sand sample type | initial strength (MPa) | Sample preparation time Min | Final strength (MPa) | retained strength (MPa) |
| Reclaimed sand (24 h) | 0.352 | 10 | 3.17 | 4.931 |
| | 0.468 | 30 | 3.189 | 4.222 |
| | 0.4450 | 60 | 3.126 | 6.099 |

Embodiment 14 adding the calcium chloride solution is to the used sand, stirring and then placing for 0 hour and 24 hours respectively, then adding water glass and stirring to obtain the mixed sand sample, and preparing the sample, measuring its initial strength, final strength and retained strength after 24 hours, and determining sodium carbonate in sand sample.

(1) Reaction Time is 0 Hour, which Means the Reclaimed Sand is not Sealed and Placed:

Regeneration process: taking 20 g calcium chloride solution with the concentration of 50 wt %, using electronic balance to weigh 500 g used sand and putting it into the stirring pot, pouring in calcium chloride solution, placing the stirring pot on the cement mortar mixer correctly, turning on the switch to select the low speed gear, stirring for three minutes, after the stirring, pouring 30 g water glass into the stirring pot, continuing to stirring for three minutes, and then preparing for the sample after the stirring.

The properties test method of the reclaimed sand obtained after regeneration for 0 hours in the embodiment is the same as in Embodiment 1, and the test results are shown in Table 10.

| Sand sample type | initial strength (MPa) | Final strength(MPa) | | | | | retained strength (MPa) | |
|---|---|---|---|---|---|---|---|---|
| Used sand(0 h) | 0.672 | 2.644 | 2.584 | 2.724 | 2.704 | 2.285 | 9.547 | 8.551 |
| | 0.671 | 2.300 | 2.273 | 2.254 | 2.603 | 2.908 | 8.215 | 10.231 |
| | 0.670 | 2.599 | 2.392 | 2.678 | 2.343 | 2.375 | 8.940 | |

In addition, the content of sodium carbonate in the reclaimed sand obtained after regeneration for 0 hour in this embodiment is tested with reference to the same test method as in Embodiment 1, and the content of sodium carbonate in the reclaimed sand is measured to be 0.40%.

(2) Reaction Time is 24 Hours:

taking 20 g calcium chloride solution with the concentration of 50 wt %, using electronic balance to weigh 500 g used sand and putting it into the stir pot, pouring in calcium chloride solution, placing the stirring pot on the cement mortar mixer correctly, turning on the switch to select the low speed gear, stirring for three minutes, after the stirring, pouring 30 g water glass into the stirring pot, continuing to stir for three minutes, after stirring, putting the mixed sand sample into the plastic film bag, and sealing and placing for 24 hours.

The properties test method of reclaimed sand obtained in the 24 hours regeneration of the embodiment is the same as that in the Embodiment 1, and the test results are shown in Table 11.

TABLE 11

| Effect of Calcium Chloride Solution Regeneration on Strength of Used Sand in Embodiment 14 | | | | | | | | |
|---|---|---|---|---|---|---|---|---|
| Sand sample type | initial strength (MPa) | Final strength (MPa) | | | | | | retained strength (MPa) |
| Reclaimed sand (24 h) | 0.332 | 1.471 | 1.191 | 1.866 | 1.825 | 1.608 | 2.342 | 2.527 |
| | 0.308 | 1.335 | 1.573 | 1.519 | 1.570 | 1.458 | 4.424 | 3.357 |
| | 0.418 | 1.258 | 1.402 | 1.219 | 1.395 | 1.255 | 3.098 | |

Determination of sodium carbonate content: using the same test method as in Embodiment 1 to measure the sodium carbonate content of the reclaimed sand, the sodium carbonate content in the reclaimed sand obtained after regeneration for 24 hours in this embodiment is 0.45%.

Comparison of the Usable Time of Sand Samples:

the hardness decreasing speed of the sand sample is an important parameter to measure the usable time of the sand sample. For sand samples with a faster decrease in hardness, the bench time is shorter. The usable time of the sand sample determines the efficiency of the sand sample and the difficulty of sample preparation. In actual production, the usable time can not be too short or too long; if the usable time is too short, it will be not conducive to sample preparation, and if the usable time is too long, it will be not conducive to core molding. The strength reduction of 20% of the sample prepared by the sand sample is used as a measure of the usable time of the sand sample, and make reference to the final strength of the first sample prepared after mixing the sand to analyze the time taken for the strength reduction of 20%, showing as Table 12 below:

TABLE 12

| Useable Time for Sand Samples | |
|---|---|
| Sand sample | Time taken to reduce the first sample strength by 20% |
| Used Sand | Less than 10 minutes |
| (Sucrose + calcium oxide) mixed solution reclaimed sand(0 h) | About 20 minutes |
| (Sucrose + calcium oxide) mixed solution reclaimed sand(24 h) | Not reduced by 20% within 1 hour of sample preparation |
| Calcium chloride solution reclaimed sand(0 h) | Not reduced by 20% within 50 minutes of sample preparation |
| Calcium chloride solution reclaimed sand(24 h) | 40 Minutes |
| (Calcium oxide + tap water) reclaimed sand(0 h) | About 40 minutes |
| (Calcium oxide + tap water) reclaimed sand(24 h) | 33 minutes |

It can be seen from the above table that the usable time of each reclaimed sand is increased compared with the used sand; and in the Table 12, the reclaimed sand regenerated by the mixture of (calcium oxide+tap water) and the reclaimed sand regenerated by the solution of calcium chloride can be used for a long time, and the regenerated sand regenerated by the mixture of (sucrose+calcium oxide) can be used for a short time (0 h).

In summary, in the case where the present disclosure uses the same mass of sand sample and the same mass of water glass, the initial strength, final strength, retained strength and sodium carbonate content of raw sand, used sand and reclaimed sand are measured and compared. Based on the data obtained, the following conclusions can be drawn: (1) the initial strength of reclaimed sand with (sucrose+calcium oxide) regeneration (24 h) is the highest, which is 60% higher than the initial strength of raw sand, and the initial strength of other reclaimed sand is higher than initial strength of raw sand; (2) the final strength: the final strength of the reclaimed sand (24 h) regenerated by the mixture of sucrose and calcium oxide is higher than the final strength of the reclaimed sand (0 h) regenerated by the mixture of calcium oxide and tap water, and the final strength is the highest among several reclaimed sand, and compared with the raw sand, the initial strength increases by 60%; and the final strength increased by 154%; the collapsibility of the reclaimed sand is slightly worse than the collapsibility of the raw sand, and better than the collapsibility of the water glass used sand, and meets the use requirements; retained strength: the retained strength of reclaimed sand regenerated with calcium chloride solution (24 h) is closest to the retained strength of raw sand, the second is reclaimed sand (0 h) using (calcium oxide+tap water), and according to the relationship that the greater the retained strength is, the worse the collapsibility is, the reclaimed sand with calcium chloride solution regeneration (24 h) has the best collapsibility. (4) Sodium carbonate content: the content of sodium carbonate in the reclaimed sand is removed, and the content of sodium carbonate in the reclaimed sand is the lowest, from 1.83% to 0.45%.

In view of that above various properties index, in the several regeneration method of the present disclosure, each property index of the reclaimed sand obtained by use (calcium oxide+tap water) to regenerate for 12 hours has the best properties, and compared with the raw sand, the initial strength increases by 60%; the final strength increases by 154%; the collapsibility of the reclaimed sand is slightly worse than the collapsibility of the raw sand, and better than the collapsibility of the water glass used sand; the content of sodium carbonate decreases by 1.38% compared with the used sand, meeting the use requirements.

In the following Embodiments 15-17 of the present disclosure, the used sand is ester hardened water glass used sand discarded by a steel casting plant in Xiangyang, Hubei province, which is obtained by crushing and screening.

The water glass used in the following Embodiments 15 to 17 of the present disclosure is indigenously produced in Wuhan, with a modulus of 3.1 and a density of 1.32.

When using the water glass, a certain amount of NaOH saturated solution is added and mixed evenly to adjust the modulus and density of water glass, and after the adjustment, the modulus of the water glass is 2.3 and the density is 1.37, and the amount of water glass is 4.0% of the raw sand.

Curing agent is organic ester produced in Yixing City, Jiangsu Province, including fast ester and slow ester; and the sand sample for properties test is prepared by hollow cylindrical sample bucket on hammer-type sample preparation machine, with a diameter of 30 mm and a height of 30 mm. The preparation steps of mixed sand are as follows: (raw sand/used sand/reclaimed sand)+organic ester mixed evenly (1.5 min) and mixing with water glass for 3 minutes to prepare the sand sample. The properties test method is the same as that in the previous embodiments.

Embodiment 15

A chemical regeneration method of ester hardened water glass used sand of this embodiment, the regeneration process is as follows:

taking 3 kg ester hardened sodium silicate used sand in muffle furnace and heating to 400° C. for 15 minutes, and after the incineration, discharging and cooling the furnace to room temperature, taking 500 g of incinerated used sand, and adding 10 g (2% by mass of sand) of calcium oxide powder, and mixing well, and then adding 20 g (4% by mass of sand) of tap water and mixing well, sealing for 12 hours, preparing mix sand sample and obtaining reclaimed sand.

Embodiment 16: the chemical regeneration method of ester hardened water glass used sand of this embodiment is basically the same as that of Embodiment 15 the difference is only: the incineration temperature of the ester-hardened sodium silicate used sand of this embodiment is 500° C.

Embodiment 16: the chemical regeneration method of ester hardened water glass used sand of this embodiment is basically the same as that of Embodiment 15 the difference is only: the incineration temperature of the ester-hardened sodium silicate used sand of this embodiment is 600° C.

Comparative Embodiment 1 the chemical regeneration method of ester hardened water glass used sand of this embodiment is basically the same as that of Embodiment 15 the difference is only:

not incinerating ester hardened sodium silicate used sand of the comparative embodiment, but directly processing the regeneration.

The properties of the reclaimed sand obtained in Embodiments 15 to 17 and comparative Embodiment 1 above are tested by the same test method as in Embodiment 1, and the results are shown in Table 13 below.

TABLE 13

Properties Comparison of Reclaimed Sand Obtained in Embodiments 15 to 17 and Comparative Embodiment 1

| Embodiments/ Comparative Embodiments | Incineration temperature of used sand | Initial strength MPa | Final strength MPa | retained strength MPa |
|---|---|---|---|---|
| Comparative Embodiment 1 | Room temperature/ unheated | 0.127 | 1.608 | 1.0 |
| Embodiment 15 | 400° C. | 0.171 | 1.711 | 0.867 |
| Embodiment 16 | 500° C. | 0.200 | 1.807 | 0.938 |
| Embodiment 17 | 600° C. | 0.189 | 1.785 | 0.832 |

What is claimed is:

1. A chemical regeneration method of water glass used sand, comprising the following steps:

S1: crushing, screening, and magnetically separating collected water glass used sand to obtain water glass used sand at a desired particle size; and S2: mixing a treatment reagent with the obtained water glass used sand in step S1 at room temperature and then stirring for 2 to 10 minutes; and after stirring, sealing and placing a mixed sand sample for no more than 24 hours to obtain reclaimed sand; wherein: the treatment reagent is one of the following reagents:

a) an emulsion composed of sucrose and calcium oxide;

b) a two-component reagent composed of calcium oxide and tap water;

c) an aqueous calcium chloride solution;

d) an aqueous magnesium chloride solution; and e) an aqueous magnesium sulfate solution.

2. The chemical regeneration method of water glass used sand according to claim 1, wherein: the water glass used sand in step S1 is any of an ester hardened used sand or a CO2 hardened used sand.

3. The chemical regeneration method of water glass used sand according to claim 2, wherein: when the water glass used sand is the ester-hardened used sand, the steps performed before step S2 also include: incinerating the ester hardened used sand, and an incineration atmosphere is air, an incineration temperature is from 350° C. to 800° C., and an incineration time is from 10 to 30 minutes.

4. The chemical regeneration method of water glass used sand according to claim 1, wherein: the two-component reagent composed of the calcium oxide and the tap water is chosen as the treatment reagent of step S2.

5. The chemical regeneration method of water glass used sand according to claim 4, wherein: a mass ratio of the tap water to the water glass used sand is: from 1 to 10:100.

6. The chemical regeneration method of water glass used sand according to claim 5, wherein: the mass ratio of the tap water to the water glass used sand is: from 2 to 4:100.

7. The chemical regeneration method of water glass used sand according to claim 4, wherein: the mass ratio of the calcium oxide to the water glass used sand is: from 0.5 to 5:100.

8. The chemical regeneration method of water glass used sand according to claim 7, wherein: the mass ratio of the calcium oxide to the water glass used sand is: from 0.5 to 1:100.

9. The chemical regeneration method of water glass used sand according to claim 1, wherein: a concentration of calcium chloride aqueous solution, magnesium chloride aqueous solution, or magnesium sulfate aqueous solution is 40 wt % to 60 wt %.

10. The chemical regeneration method of water glass used sand according to claim 1, wherein: sealing and placing the mixed sand sample for 12 hours.

* * * * *